US008973608B2

(12) United States Patent
Selwyn

(10) Patent No.: US 8,973,608 B2
(45) Date of Patent: Mar. 10, 2015

(54) ADJUSTABLE FLUID PRESSURE AMPLIFIER

(76) Inventor: Frederick Philip Selwyn, Bude (GB)

( * ) Notice: Subject to any disclaimer, the term of this patent is extended or adjusted under 35 U.S.C. 154(b) by 527 days.

(21) Appl. No.: 13/261,243

(22) PCT Filed: Apr. 5, 2011

(86) PCT No.: PCT/GB2011/050673

§ 371 (c)(1),
(2), (4) Date: Mar. 29, 2012

(87) PCT Pub. No.: WO2011/124909

PCT Pub. Date: Oct. 13, 2011

(65) Prior Publication Data

US 2012/0186683 A1 Jul. 26, 2012

(30) Foreign Application Priority Data

Apr. 6, 2010 (GB) ..... 1005685.1

(51) Int. Cl.
*A01G 25/16* (2006.01)
*F17D 3/00* (2006.01)
*F04F 7/02* (2006.01)

(52) U.S. Cl.
CPC ..... *F04F 7/02* (2013.01)
USPC ..... 137/624.14; 417/225

(58) Field of Classification Search
CPC ..... F04F 7/02; G05D 11/03
USPC ..... 137/102, 103, 115.05, 115.06, 624.14, 137/825, 833, 877; 417/53, 225, 226
See application file for complete search history.

(56) References Cited

U.S. PATENT DOCUMENTS

| | | | | |
|---|---|---|---|---|
| 2,995,292 | A * | 8/1961 | Fleming | 417/225 |
| 4,627,794 | A * | 12/1986 | Silva | 417/225 |
| 4,638,831 | A * | 1/1987 | Lindgren | 137/115.05 |
| 6,206,041 | B1 * | 3/2001 | Selwyn | 137/624.14 |

* cited by examiner

*Primary Examiner* — John K Fristoe, Jr.
*Assistant Examiner* — Kelsey Rohman
(74) *Attorney, Agent, or Firm* — Ira S. Dorman

(57) ABSTRACT

The amplifier includes a housing containing a chamber with a delivery outlet containing a non-return delivery valve. An inlet pipe projects into the chamber and a resilient obturator ring is engaged with and located about the pipe to be resiliently-movable in the chamber. An annular exhaust aperture surrounding the pipe can be sealed by the obturator ring, the obturator ring being responsive to fluid flow in the inlet pipe such that fluid flow causes the obturator ring to oscillate between conditions which alternately permit and prevent fluid from leaving the chamber through the exhaust aperture thereby causing a pulsed pressure increase in the fluid flowing through the delivery outlet. An adjuster is provided for adjusting the distance by which the fluid inlet pipe projects into the chamber and moves the pipe using co-operably inclined faces. The obturator ring and the delivery valve are shaped to create a venturi effect.

13 Claims, 3 Drawing Sheets

ADJUSTABLE FLUID PRESSURE AMPLIFIER

TECHNICAL FIELD OF THE INVENTION

This invention relates to a fluid pressure amplifier.

BACKGROUND

EP 0 891 491 A discloses a fluid pressure amplifier which includes a pipe having a fluid inlet and a fluid outlet and containing an array of holes. A chamber is formed around the pipe, surrounding the holes, with an obturator ring surrounding the pipe and resiliently-movable in the chamber to co-operate with an annular exhaust aperture surrounding the pipe which can be sealed by the ring. Fluid pressure in the pipe causes the ring to oscillate between conditions which alternately permit and prevent fluid from leaving the chamber through the exhaust aperture, causing a pulsed pressure increase in the fluid leaving the fluid outlet.

The fluid pressure amplifier can be used to increase the outlet pressure of fluid in a pipe where the inlet pressure is low, for example where the pipe is submerged in a river or connected to another low-pressure fluid source. Such an amplifier may be used in various situations, so that the pressure of the fluid source may vary and the required outlet pressure and/or volume may change.

The present invention seeks to provide a new and inventive form of fluid pressure amplifier which is compact, inexpensive, and is capable of providing significantly improved efficiency over a greater range of operating conditions.

SUMMARY OF THE INVENTION

The present invention proposes a fluid pressure amplifier which includes a housing containing a chamber, an inlet pipe projecting into the chamber, a delivery outlet communicating with the inlet pipe, a resilient obturator ring engaged with and located about the inlet pipe and resiliently-movable in the chamber, an annular exhaust aperture surrounding the inlet pipe which can be sealed by the obturator ring, the obturator ring being responsive to fluid flow in the inlet pipe such that fluid flow causes the obturator ring to oscillate between conditions which alternately permit and prevent fluid from leaving the chamber through the exhaust aperture, thereby causing a pulsed pressure increase in the fluid flowing through the delivery outlet, and means for adjusting the distance by which the fluid inlet pipe projects into the chamber to vary the distance between the obturator ring and the annular exhaust aperture, characterised in that the inlet pipe terminates within the chamber and the delivery outlet is fixed with the housing.

The internal surface of the chamber may be shaped to reduce turbulence and friction and produce an improved flow from the inlet pipe into the annular exhaust aperture, resulting in improved efficiency. Furthermore, the internal profile of the chamber may facilitate the expulsion of entrained gases which might otherwise tend to accumulate in the chamber and reduce operating efficiency.

The exhaust aperture is preferably shaped to provide a gradual reduction in cross-sectional area leading smoothly into a section of gradually increasing cross sectional area, thereby creating a venturi effect as fluid flows through the aperture. The obturator ring may also be shaped in relation to the annular exhaust aperture to create a venturi effect as fluid flows between the two. This venturi effect substantially reduces the opening requirement of the obturator valve and also the closure time, thereby decreasing the impact force and associated valve wear whilst increasing the pressure achievable at the delivery outlet.

When viewed in cross-section, the obturator ring is preferably D-shaped with a convex face directed towards the annular exhaust aperture and an opposite face which is substantially flat or concave.

In a preferred form of the fluid pressure amplifier an adjuster is rotatably engaged with the pipe and with the housing such that the adjuster can vary the distance by which the fluid inlet pipe projects into the chamber using co-operably inclined faces. The inclined faces may be associated with the housing and/or the pipe and/or the adjuster itself.

The delivery outlet may incorporate a non-return valve having a valve element which co-operates with a valve seat fixed with the housing. Preferably the valve element is ring-shaped and the valve seat is provided by a bi-conical guide.

The chamber preferably includes at least one auxiliary port of relatively small cross-sectional area.

BRIEF DESCRIPTION OF THE DRAWINGS

The following description and the accompanying drawings referred to therein are included by way of non-limiting example in order to illustrate how the invention may be put into practice. In the drawings.

DETAILED DESCRIPTION OF THE DRAWINGS

Figure 1:
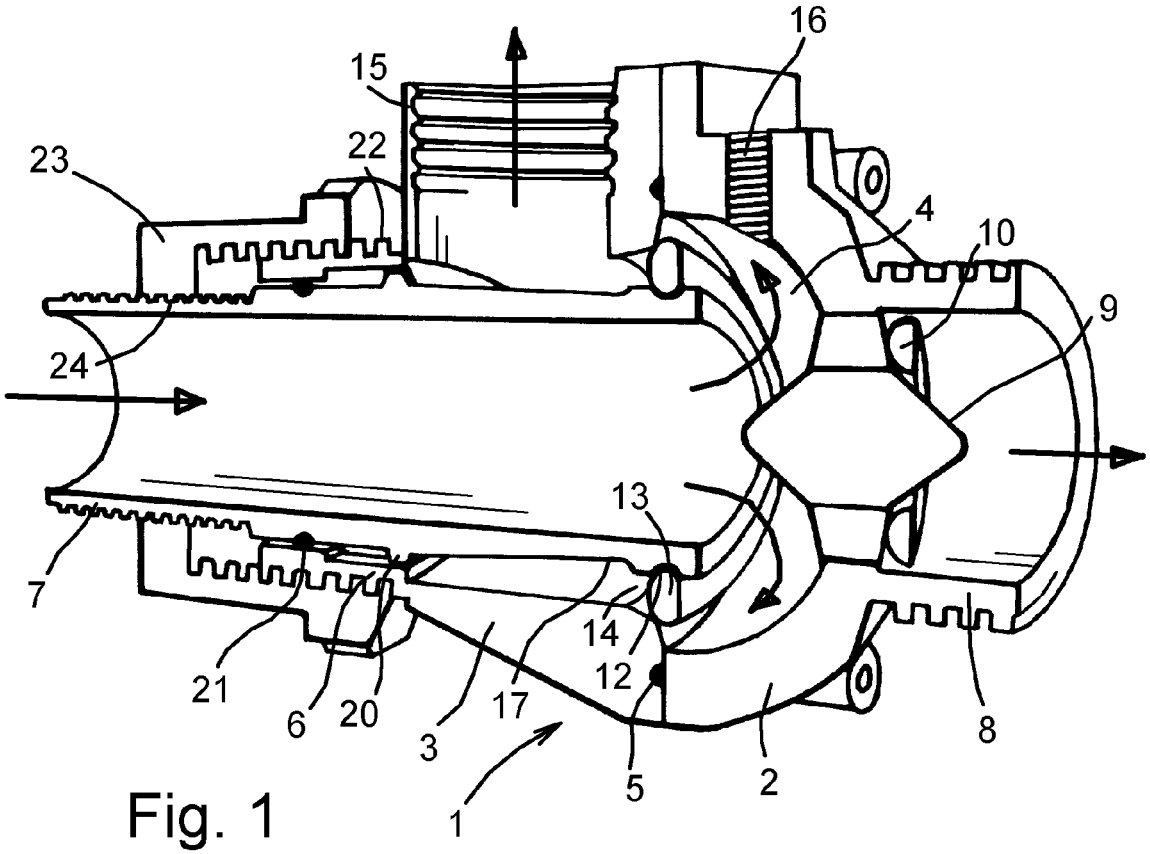
FIG. 1 is a sectional view of a fluid pressure amplifier in accordance with the invention.

The fluid pressure amplifier is similar to a ram pump. Referring firstly to FIG. 1, the amplifier includes a housing 1 formed by front and rear molded parts 2 and 3 which are bolted or otherwise secured together, sealed by an O-ring 5, to define an internal generally hemispherical chamber 4. The rear part 3 is formed with a sleeve 6 to receive an inlet pipe 7 which projects into the chamber 4 in alignment with a delivery outlet 8 moulded with the front part 2. The delivery outlet 8 is formed with a bi-conical guide 9 which provides a seat for a ring-shaped delivery valve 10, acting as a non-return valve.

The inner end of the pipe 7 has an external annular groove 12 within which is located a resilient obturator ring 13. The obturator ring co-operates with an annular aperture 14, formed between the rear part 3 and the outer surface of the inlet pipe 7, which leads to a radial exhaust port 15. The front part 2 is also formed with a small-diameter auxiliary port 16 which may receive a pressure relief valve to prevent excessive pressure within the system and/or other auxiliary equipment such as an air pump which can be operated by hydraulic pressure pulses. The port 16 receives a sealed plug if not in use.

Figure 6:
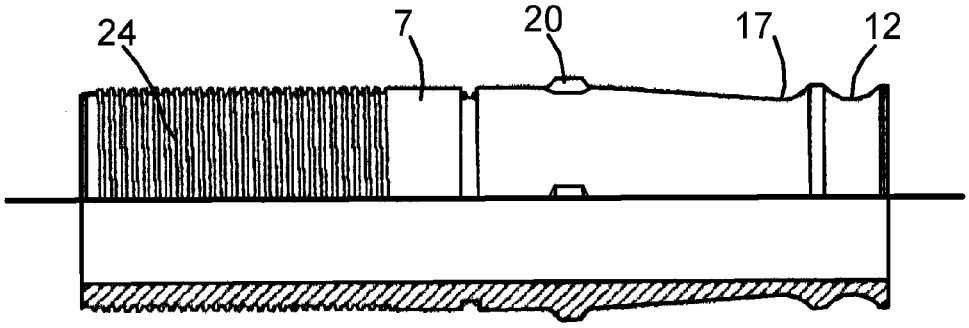
FIG. 6 is a side view of the inlet pipe of the fluid pressure amplifier, shown partly in axial section.

An additional groove 17 may be formed in the inlet pipe 7 extending within the aperture 14, as shown in FIG. 6, to provide a smoother flow recovery on the exit side of the aperture 14.

The pipe 7 is formed with circumferentially-spaced guide ribs 20 which centers the pipe and prevent it from rotating within the sleeve 6. The pipe is sealed to the sleeve 6 by a further O-ring 21. The sleeve 6 is formed externally with a coarse screw thread 22 onto which a differential adjuster nut 23 is threaded, and the rear end of the differential adjuster 23 is formed with an fine screw thread 24 which is, in turn, threadedly engaged with the pipe 7. In its normal rest condition there will be a gap between the obturator ring 13 and the annular aperture 14, but by rotating the differential adjuster 23 it is possible to move the pipe 7 in and out of the housing to accurately adjust the size of the gap.

Figure 2:
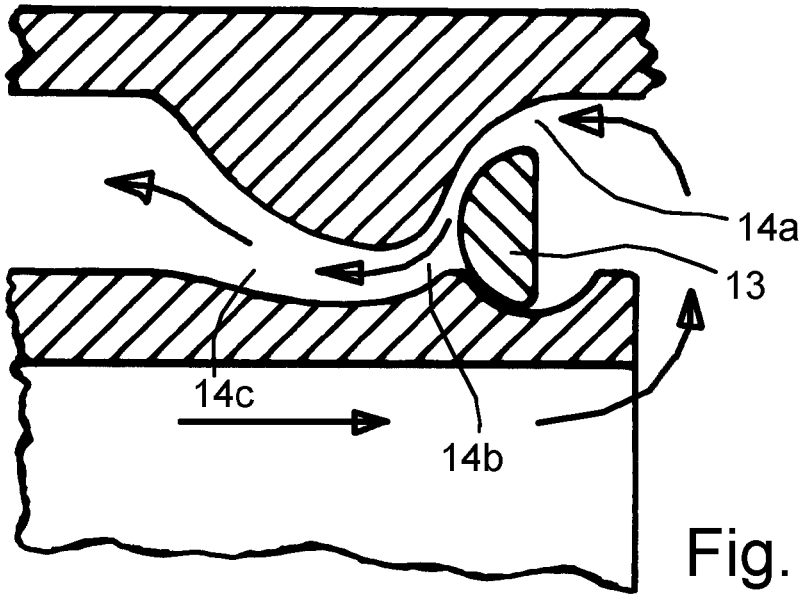
FIG. 2 is an enlarged cross sectional detail of part of the fluid pressure amplifier in the region of the obturator ring.
Figure 3:
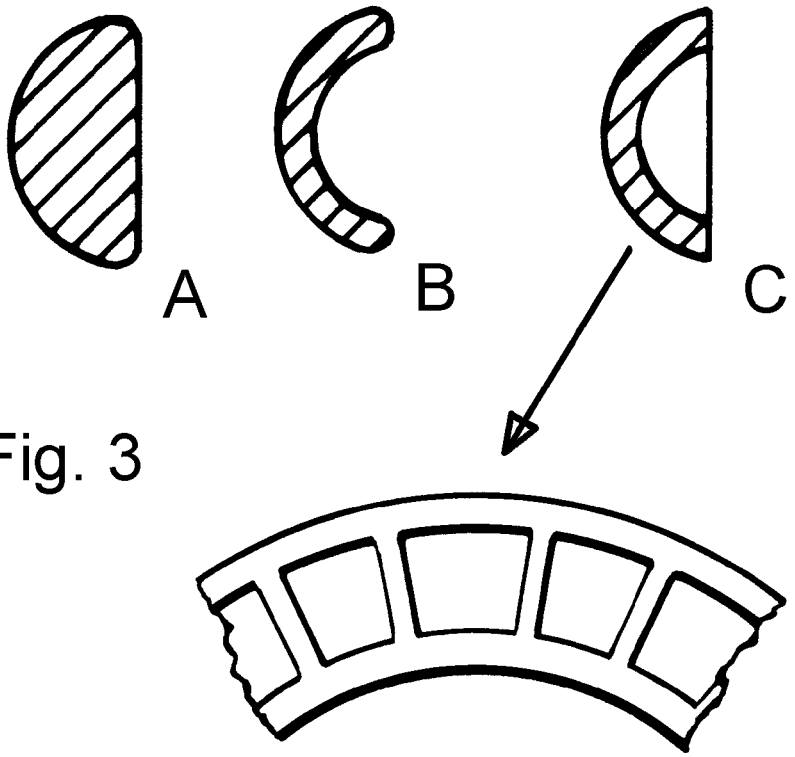
FIG. 3 is a cross section through three possible forms of obturator ring.
Figure 4:
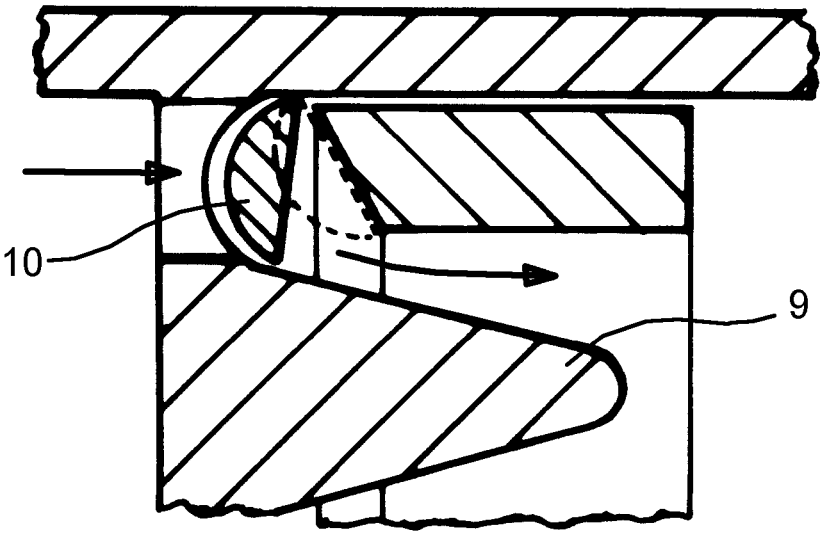
FIG. 4 is an enlarged cross sectional detail of part of the fluid pressure amplifier in the region of the delivery valve.

When a fluid such as water flows through the inlet pipe 7 it enters the chamber 4 and flows through the aperture 14 to exhaust. The internal surface of the chamber may be shaped to reduce turbulence and friction and produce a smooth uninterrupted flow from the inlet pipe 7 into the annular exhaust aperture 14. Furthermore, the smoothly curved internal profile of the chamber facilitates the expulsion of entrained gases which might otherwise tend to accumulate in the chamber and reduce operating efficiency. As shown in the cross-sectional detail of FIG. 2, the exhaust aperture 14 is shaped to form a venturi or restriction as water flows through the exhaust aperture. The aperture provides a gradual reduction in cross-sectional area 14*a* leading to a restriction 14*b* which in turn leads smoothly to a section of gradually increasing cross sectional area 14*c*. In addition, the opposing faces of the obturator ring 13 and the exhaust aperture can be curved to create a venturi, such that as the flow increases between these two surfaces, low pressure is generated in this region causing the obturator ring 13 to be urged against exhaust aperture 14 by the pressure differential. It is also important to note that the venturi has a smooth profile, which enables the velocity of fluid entering the exhaust aperture to increase smoothly upon entering the valve, and decrease again smoothly on exiting from the valve, thus minimizing turbulent flow and maximizing the efficiency of the pressure amplifier. FIG. 3 shows three example cross sections of the obturator ring 13, which in addition to being a solid planar-convex D-shape as in A, could also be of hollow concave-convex D-shape as in B, or a hollow D-shape provided with internal webs as in C. Such obturator rings maintain the integrity of the profile, and the material from which it is formed, whilst minimising the mass and flexibility of the ring in order to maximize the efficiency of the pressure amplifier over a greater range of adjustment. The venturi effect enables a high flow rate to be produced through a relatively small valve opening, resulting in a high pressure wave upon closure of the obturator ring 13. This pressure wave causes the delivery valve 10 to open and creates a flow through the delivery outlet 8 at a higher pressure than the input pressure. As shown in FIG. 4, the delivery valve 10 can be shaped in the same way as the obturator ring 13 to produce a venturi effect in co-operation with the opposing surfaces of the fluid pressure amplifier so that the flow rate through the delivery valve can be maximized in relation to its area of opening. Increasing pressure causes the delivery valve element to distort angularly away from the opening, as shown in dashed outline, to allow maximum flow. When the pressure falls the delivery valve 10 resiliently snaps shut assisted by the back pressure. This creates a negative pressure in the chamber 4, allowing the obturator ring 13 to return to its starting position and re-open the exhaust flow through the aperture 14. The flow to the exhaust port then builds up again to repeat the cycle.

In operation, the fluid pressure amplifier can lift water to thirty or forty times the distance of the gravity head which produces a particular fluid pressure at the inlet pipe. Adjustment of the nut 23 allows the output flow and pressure to be "tuned" according to the input flow and pressure. The axial position of the inlet pipe 7 can thus be varied by means of a single hand-operated adjuster with a single seal 21 which seals continuously through the range of adjustment, thereby minimising the possible ingress of air during the adjustment process.

Figure 5:
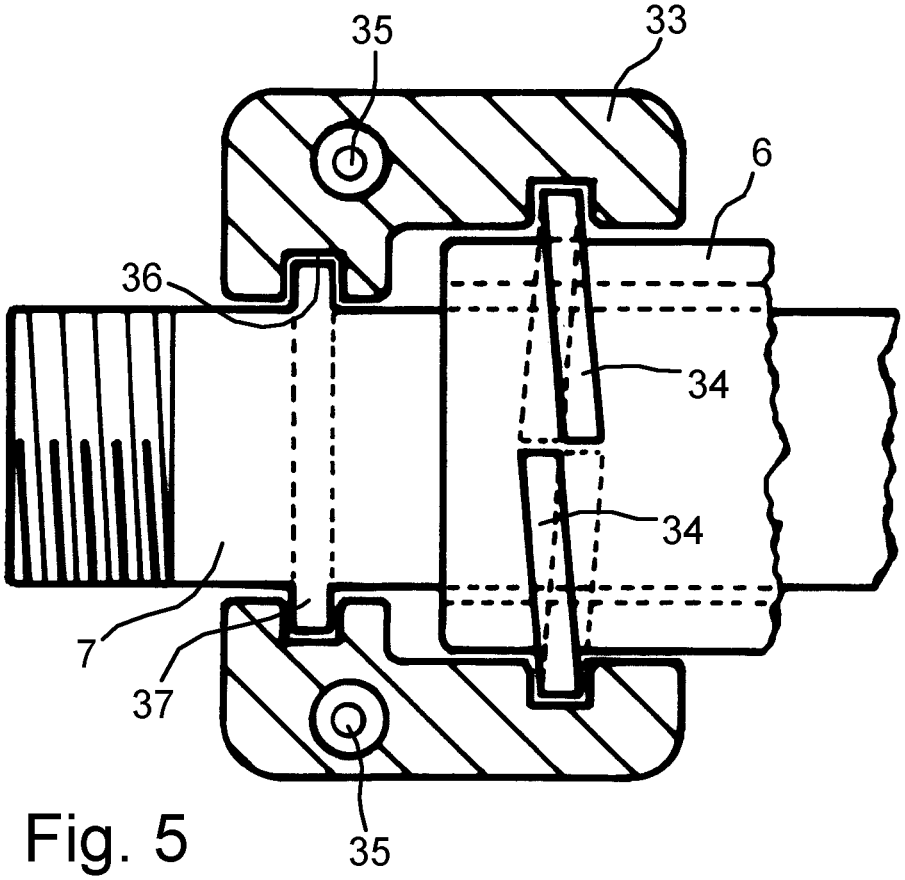
FIG. 5 is a sectional view of an alternative means of adjustment which can be used in the fluid pressure amplifier.

FIG. 5 shows an alternative way of adjusting the axial position of the pipe 6 using a cam adjuster 33. The sleeve 6 is formed externally with one or more inclined cam elements 34. The adjuster 33 is formed in two or more parts which are secured about the cam elements 34 by rivets or bolts 35. The rear end of the adjuster is formed with an internal annular groove 36 which receives an annular flange 37 formed on the pipe 7. By rotating the adjuster 33 the cam elements 34 act to move the cam axially of the sleeve 6 so that the cam adjuster carries the pipe 7 in and out of the housing.

Fluid exiting from the exhaust port 15 is ducted away, and may be utilized to complete a siphon when the remote ends of the inlet and exhaust pipes are both submerged. The exhaust port 15 may have an internal or external thread, a flange or hose tail type connection. An automatic hydraulic control valve may also be attached to the exhaust port enabling the pumping action to be controlled (started and stopped) in response to a varying water supply without the need to manually adjust the device.

Whilst the above description places emphasis on the areas which are believed to be new and addresses specific problems which have been identified, it is intended that the features disclosed herein may be used in any combination which is capable of providing a new and useful advance in the art.

The invention claimed is:

1. A fluid pressure amplifier which includes a housing (1) containing a chamber (4), an inlet pipe (7) projecting into the chamber, a delivery outlet (8) communicating with the inlet pipe, a resilient obturator ring (13) engaged with and located about the inlet pipe and resiliently-movable in the chamber, an annular exhaust aperture (14) surrounding the inlet pipe which can be sealed by the obturator ring, the obturator ring (13) being responsive to fluid flow in the inlet pipe such that fluid flow causes the obturator ring to oscillate between conditions which alternately permit and prevent fluid from leaving the chamber through the exhaust aperture, thereby causing a pulsed pressure increase in the fluid flowing through the delivery outlet, and means (23) for adjusting the distance by which the fluid inlet pipe projects into the chamber to vary the distance between the obturator ring and the annular exhaust aperture, characterised in that the inlet pipe (7) terminates within the chamber (4) and the delivery outlet (8) is fixed with the housing.

2. A fluid pressure amplifier according to claim 1 in which the annular exhaust aperture (14) is shaped to provide a gradual reduction in cross-sectional area leading smoothly into a section of gradually increasing cross sectional area, thereby creating a venturi effect as fluid flows through the aperture.

3. A fluid pressure amplifier according to claim 1 in which, when viewed in cross-section, the obturator ring (13) has a convex face directed towards the annular exhaust aperture (14) and an opposite face which is substantially flat or concave.

4. A fluid pressure amplifier according to claim 1 in which an adjuster (23) is rotatably engaged with the inlet pipe (7) and with the housing (1) such that the adjuster can vary the distance by which the fluid inlet pipe projects into the chamber using co-operably inclined faces.

5. A fluid pressure amplifier according to claim 4 in which the co-operably inclined faces are associated with the adjuster (23) and one or both of the housing (1) and the inlet pipe (7).

6. A fluid pressure amplifier according to claim 5 in which the co-operably inclined faces are provided by screw threads (22, 24).

7. A fluid pressure amplifier according to claim 6 in which the adjuster (23) is threadedly engaged with the housing (1) and the inlet pipe (7) using threads of different pitch (22, 24).

8. A fluid pressure amplifier according to claim 1 in which the delivery outlet (8) incorporates a non-return valve having a valve element (10) which co-operates with a valve seat (9) fixed with the housing (1).

9. A fluid pressure amplifier according to claim 8 in which the valve element (10) is ring-shaped and the valve seat (9) is provided by a bi-conical guide.

10. A fluid pressure amplifier according to claim 8 in which the valve element (10) is ring-shaped and co-operates with adjacent fixed surfaces to create a venturi effect which causes the valve element to deform such as to increase the flow rate through the non-return valve.

11. A fluid pressure amplifier according to claim 1 in which the chamber includes at least one auxiliary port of relatively small cross-sectional area.

12. A fluid pressure amplifier according to claim 1 in which the housing comprises two moulded parts which are releasably connected together, wherein one part provides the annular exhaust aperture (14) and the other part provides the delivery outlet (8).

13. A fluid pressure amplifier according to claim 1 in which the chamber (4) is substantially hemispherical.

* * * * *